US009342008B2

(12) United States Patent
Wu et al.

(10) Patent No.: US 9,342,008 B2
(45) Date of Patent: May 17, 2016

(54) FUSER MEMBER COMPOSITIONS

(71) Applicant: Xerox Corporation, Norwalk, CT (US)

(72) Inventors: Jin Wu, Pittsford, NY (US); David J. Gervasi, Pittsford, NY (US); Matthew M. Kelly, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 204 days.

(21) Appl. No.: 14/155,881

(22) Filed: Jan. 15, 2014

(65) Prior Publication Data

US 2015/0198915 A1 Jul. 16, 2015

(51) Int. Cl.
*G03G 15/20* (2006.01)
*H01B 1/12* (2006.01)

(52) U.S. Cl.
CPC ..... *G03G 15/206* (2013.01); *G03G 2215/2032* (2013.01)

(58) Field of Classification Search
CPC ..... G03G 15/206; G03G 2215/2032; G03G 15/20; H01B 1/12
USPC ..... 252/500; 399/333
See application file for complete search history.

(56) References Cited

U.S. PATENT DOCUMENTS

2007/0026225 A1* 2/2007 Chen ..... B32B 27/38 428/336
2007/0231568 A1* 10/2007 Kanakarajan ..... C09J 179/08 428/343
2009/0142567 A1* 6/2009 Kanakarajan ..... B32B 5/26 428/220

* cited by examiner

*Primary Examiner* — Mark Kopec
*Assistant Examiner* — Danny N Kang
(74) *Attorney, Agent, or Firm* — Eugene O. Palazzo

(57) ABSTRACT

A fuser member that contains a mixture of a polyimide and an aramid polymer.

19 Claims, 6 Drawing Sheets

FUSER MEMBER COMPOSITIONS

This disclosure is generally directed to fuser members useful in electrophotographic imaging apparatuses, including digital, image on image, and transfix solid ink jet printing systems, and where the fuser members are comprised of a mixture of a polyimide and an aramid polymer.

BACKGROUND

In the process of xerography, a light image of an original to be copied is typically recorded in the form of a latent electrostatic image upon a photosensitive or a photoconductive member with subsequent rendering of the latent image visible by the application of particulate thermoplastic material, commonly referred to as toner. The visual toner image can be either fixed directly upon the photosensitive member or the photoconductor member, or transferred from either member to another support, such as a sheet of plain paper, with subsequent affixing by, for example, the application of heat and pressure of the image thereto.

To affix or fuse toner material onto a support member like paper by heat and pressure, it is usually necessary to elevate the temperature of the toner and simultaneously apply pressure sufficient to cause the constituents of the toner to become tacky and coalesce. In both the xerographic as well as the electrographic recording arts, the use of thermal energy for fixing toner images onto a support member is known.

One approach to the heat and pressure fusing of toner images onto a support has been to pass the support with the toner images thereon between a pair of pressure engaged roller members, at least one of which is internally heated. For example, the support may pass between a fuser roller and a pressure roller. During operation of a fusing system of this type, the support member to which the toner images are electrostatically adhered is moved through the nip formed between the rollers with the toner image contacting the fuser roll thereby to effect heating of the toner images within the nip.

Engineering system polymers can possess a number of desirable properties including low mass densities, chemical stability, and high strength-to-mass ratio. Thus, these polymeric materials may have a low thermal conductivity near room temperature, and where foams thereof of amorphous polymers are used for thermal insulation. In situations where heat transfer is important, these polymeric materials are at a disadvantage. Also, polymers for heat exchangers and thermal management usually require high thermal conductivity, and where there are selected metals, such as copper, aluminum, and titanium (Cu, Al, Ti) and certain ceramics, such as aluminum nitride, diamond and graphite (AlN, diamond, graphite). Further, metals and ceramic fillers have been incorporated into polymeric materials, however, this incorporation can decrease the Young's modulus of the polymeric materials and can have other disadvantages, such as increased brittleness and decreased break strength.

There is a need for xerographic fusing members that substantially avoid or minimize the disadvantages of a number of known fusing members.

Also, there is a need for environmentally acceptable fuser members with excellent and enhanced thermal conductivity, and where such members are free of metals and ceramics.

Further, there is a need for economical xerographic fuser members that possess excellent and improved thermal diffusivities and improved thermal conductivities, especially as compared to a polyimide fuser belt, and which economical xerographic fuser members have an advantageous acceptable Young's Modulus.

Yet also there is a need for fuser members that permit a reduction in energy consumption and a corresponding cost reduction, in addition to improvements in thermal conductivity that can reduce the energy, and warm-up time for a xerographic internally heated fuser belt architecture.

Additionally, there is a need for fuser member compositions and mixture that possess self-release characteristics from a number of substrates, such as stainless steel, and where an external release layer on the metal substrate can be avoided when such members are prepared.

Yet another need resides in providing seamless fusing members and seamless fusing belts that can be generated at a cost lower than known centrifugal generated seamless polyimide belt processes.

Additionally, there is a need for fusing members that can be economically and efficiently manufactured.

Also, there is a need for fusing members with a combination of excellent mechanical properties thereby extending the life time thereof, and with stable substantially consistent characteristics as illustrated herein.

These and other needs are achievable in embodiments with the fuser members and components thereof disclosed herein.

SUMMARY

Disclosed is a fuser member comprising a mixture of a polyimide and an aramid polymer.

Also disclosed is a fuser belt comprised in sequence of a substrate comprised of a mixture of polyimides and aramid fibers, an intermediate layer comprising a silicone, a fluoroelastomer, or mixtures thereof, and a fluoropolymer overcoat layer present on the intermediate layer.

Further disclosed is a method of forming a fuser member comprising flow coating a composition comprising a polyimide precursor, a plurality of aramid fibers, and a solvent onto a supporting substrate, and pre-curing the coating composition at a temperature of from about 125° C. to about 250° C., followed by a final curing at a temperature of from about 250° C. to about 370° C., and wherein the aramid fibers are represented by the following formula/structure

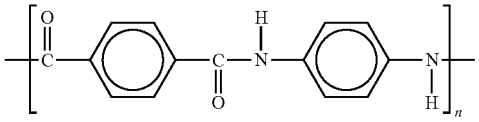

where n is a number of from about 20 to about 500, which fuser member has a temperature dependent thermal diffusivity of from about 0.2 to about 0.4 square millimeters per second, and a temperature dependent thermal conductivity of from about 0.4 to about 0.6 watt per meter per Kelvin.

Additionally disclosed is a xerographic fuser member comprising a mixture of a polyimide and aramid fibers as represented by the following formula/structure

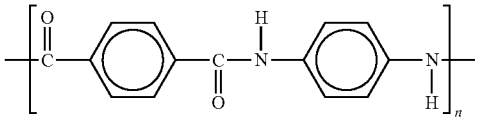

where n represents the number of repeating segments, and wherein the member has a thermal diffusivity of from about 0.2 to about 0.4 square millimeter per second at about 25° C., and a thermal conductivity of from about 0.4 to about 0.6 watt per meter per Kelvin at about 25° C.

FIGURES

The following Figures are provided to further illustrate embodiments of the fuser members and processes disclosed herein.

EMBODIMENTS

The disclosed fuser member comprises a mixture of a polymer, such as a polyimide polymer and an aramid component.

In various embodiments, the disclosed fuser member can include, for example, a substrate layer comprising a mixture of a polyimide polymer and an aramid polymer with one or more functional layers formed thereon. The layer mixture can be formed in various shapes, such as a belt, with the thickness of the fuser member being, for example, from about 30 to about 1,000 microns, from about 100 to about 800 microns, from about 150 to about 500 microns, from about 100 to about 125 microns, or from about 75 to about 80 microns.

The arrows when present in each of the following Figures illustrate the direction of movement of the various components shown.

Figure 1:
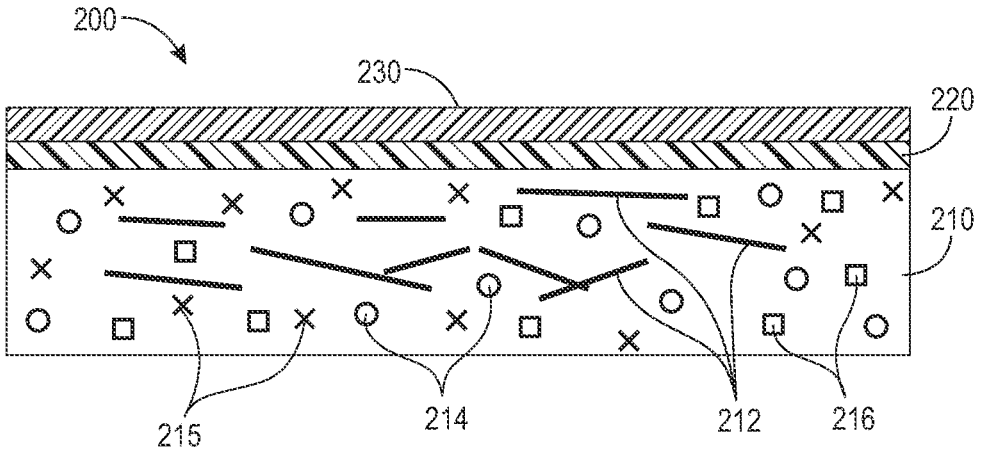
FIG. 1 illustrates an exemplary embodiment fuser member having a belt substrate of the present disclosure.

FIG. 1 illustrates an exemplary embodiment of a fusing or transfix member 200 of the present disclosure, and which member can include a substrate, such as substrate 210, comprised of aramid polymer fibers 212 dispersed in a polyimide 214, and which mixture can include optional conductive components 215 and optional polymers 216, with one or more functional intermediate layers, such as layer 220, and an outer surface layer 230, formed thereon.

Figure 2:
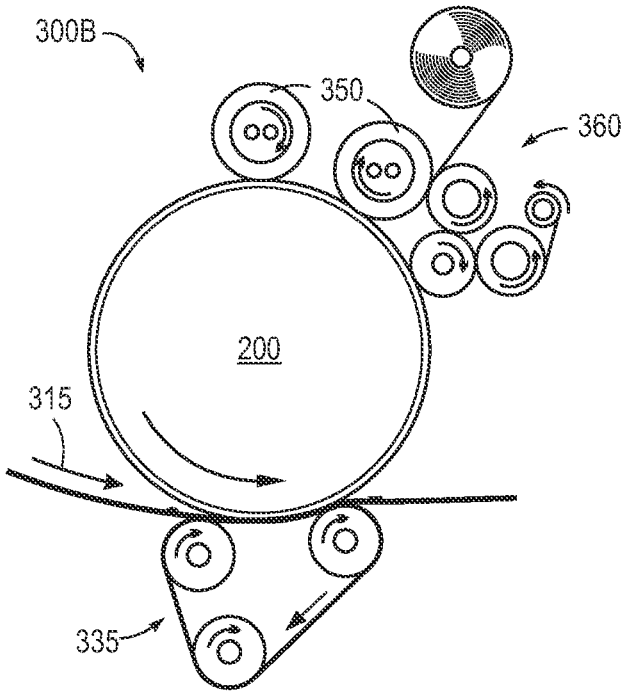
FIG. 2 illustrates an exemplary fusing configuration that includes the fuser member shown in FIG. 1 in accordance with the present disclosure.
Figure 3:
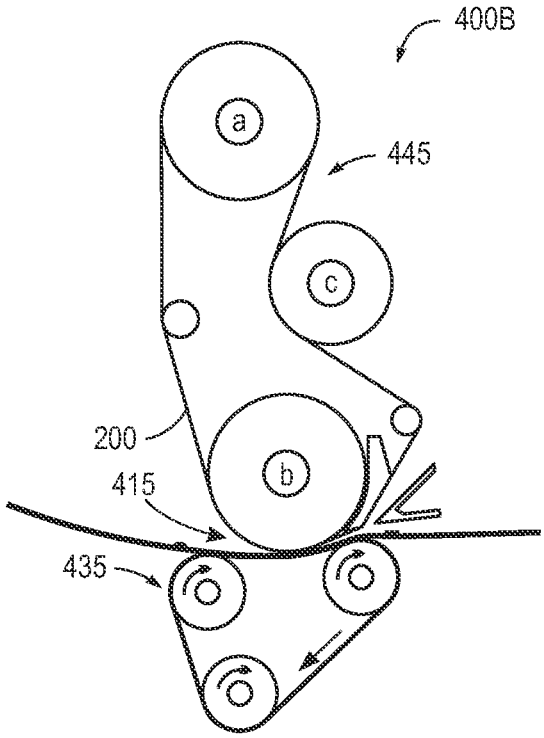
FIG. 3 illustrates an exemplary fusing configuration that includes the fuser member shown in FIG. 1 in accordance with the present disclosure.

FIGS. 2 and 3 illustrate exemplary xerographic fusing configurations, systems and processes in accordance with the present teachings, noting that although a xerographic printer is described herein the disclosed apparatus and method can be applied to other printing technologies, examples of which include offset printing, inkjet printing and solid transfix printing.

More specifically, FIG. 2 illustrates a fusing configuration 300B that includes the fuser member 200, which can be in the form of a belt, of FIG. 1 and that forms a fuser nip with a pressure applying mechanism 335, such as a pressure belt, for an image supporting material, such as paper 315. In various embodiments, the pressure applying mechanism 335 can be used in combination with a heat lamp (not shown) to provide both the pressure and heat for fusing the toner particles on the image supporting material 315. In addition, the configuration 300B can include one or more external heat rolls 350 together with a cleaning web 360.

FIG. 3 illustrates a fusing configuration 400B that can include a fuser member, such as the member 200 of FIG. 1, encircling the drum of FIG. 2 which can be in the form of the belt that forms a fuser nip with a pressure applying mechanism 435, for a media substrate 415. In various embodiments, the pressure applying mechanism 435 can be used in a combination with a heat lamp (not shown) to provide both the pressure and heat to enable the fusing of the toner particles on the media substrate 415. In addition, the configuration 400B can include a mechanical system 445 to move the fuser member 200 to thereby fuse the toner particles, and forming developed xerographic images on the media substrate 415. The mechanical system 445 can include one or more rolls 445*a* to *c*, which can also be used as heat rolls when desired.

Figure 4:
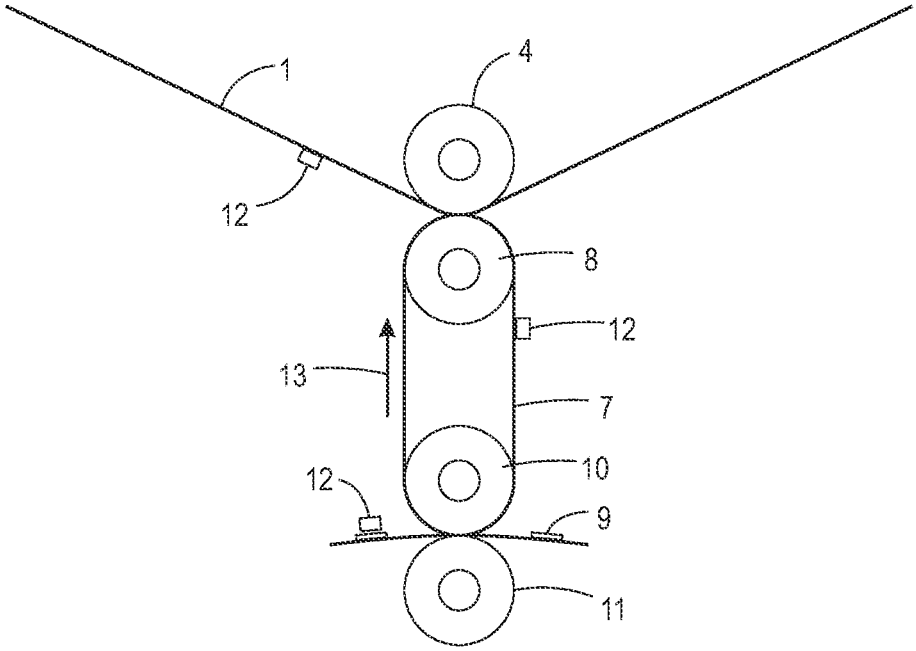
FIG. 4 illustrates a fuser configuration in a transfix apparatus in accordance with the present disclosure.

FIG. 4 illustrates a view of an embodiment of a transfix member 7, which may be in the form of a belt, sheet, film, or like form. The transfix member 7 is constructed similarly to the fuser member described above. The developed image 12, positioned on intermediate transfer member 1, is brought into contact with and transferred to transfix member 7 via rollers 4 and 8. Roller 4 and/or roller 8 may or may not have heat associated therewith. Transfix member 7 proceeds in the direction of arrow 13. The developed image is transferred and fused to a copy substrate 9 as copy substrate 9 is advanced between rollers 10 and 11. Rollers 10 and/or 11 may or may not have heat associated therewith.

The disclosed fuser member composition mixture of the polyimide and the aramid polymer, such as an aramid polymer in the configuration of fibers can be flow coated on a welded or seamless stainless steel belt or drum, a seamless aluminum belt or drum, an electroformed seamless nickel belt or drum, or a glass drum at the desired product circumferences. The polyimide source and the aramid polymer mixture can be partially cured, or pre-cured at, for example, from about 150° C. to about 250° C., from about 125° C. to about 250° C., from about 125° C. to about 225° C., from about 170° C. to about 220° C., or from about 200° C. to about 210° C. for a suitable time of, for example, from about 30 to about 90 minutes, or from about 40 to about 75 minutes, and self-releases from the welded or seamless stainless steel belt or drum, a seamless aluminum belt or drum, an electroformed seamless nickel belt or drum, or the glass drum, and then is further completely cured at, for example, from about 250° C. to about 370° C., or from about 320° C. to about 340° C., for a suitable time of, for example, from about 30 to about 150 minutes, or from about 60 to about 120 minutes. Alternatively, the polyimide source and aramid polymer mixture can be pre-cured and then completely cured prior to being self released.

There is also disclosed herein a method of forming a fuser member suitable for use with an image, such as a xerographic image forming system. The method comprises, for example, the flow coating of a composition comprising a polyimide or a source of a polyimide, an aramid polymer, and a solvent onto the outer surface of a rotating substrate, such as a welded or seamless stainless steel substrate or drum, a seamless aluminum belt or drum, an electroformed seamless nickel belt or drum, or a glass drum at the desired product circumferences. The coating is partially cured and then subsequently further cured as illustrated herein, or completely cured on for example, a rotating substrate.

Fuser Member Compositions

The disclosed fuser member can be comprised of a mixture of a polyimide and an aramid polymer, which mixture possesses excellent thermal diffusivity of, for example, from about 0.2 to about 0.4 square millimeter per second ($mm^2/s$), or from about 0.25 to about 0.35 square millimeter per second as measured by a number of known methods, and more specifically, by an ALFA 447 Nanoflash instrument and an improved thermal conductivity at certain temperatures of, for example, from about 0.4 to about 0.6 watt per meter per Kelvin as represented by (W/(m·K)) or W/(m*K), or from about 0.45 to about 0.55 watt per meter per Kelvin as measured by a number of known methods, and more specifically, by an ALFA 447 Nanoflash instrument. The disclosed fuser member thermal diffusivity and the thermal conductivity can be temperature dependent, see for example FIGS. 5, 6, 7, and 8.

In an embodiment, the disclosed fuser substrate layer composition comprises a polyimide precursor, such as a polyamic acid, and in particular a polyamic acid of biphenyl tetracarboxylic dianhydride/phenylenediamine, and aramid polymers in the form of, for example, fibers.

Polyimides

Examples of polyimides selected for the fuser members illustrated herein can be formed from a polyimide precursor of a polyamic acid that includes one of a polyamic acid of pyromellitic dianhydride/4,4'-oxydianiline, a polyamic acid of pyromellitic dianhydride/phenylenediamine, a polyamic acid of biphenyl tetracarboxylic dianhydride/4,4'-oxydianiline, a polyamic acid of biphenyl tetracarboxylic dianhydride/phenylenediamine, a polyamic acid of benzophenone tetracarboxylic dianhydride/4,4'-oxydianiline, a polyamic acid of benzophenone tetracarboxylic dianhydride/4,4'-oxydianiline/phenylenediamine, and the like, and mixtures thereof. After curing, there results polyimides such as a polyimide of pyromellitic dianhydride/4,4'-oxydianiline, a polyimide of pyromellitic dianhydride/phenylenediamine, a polyimide of biphenyl tetracarboxylic dianhydride/4,4'-oxydianiline, a polyimide of biphenyl tetracarboxylic dianhydride/phenylenediamine, a polyimide of benzophenone tetracarboxylic dianhydride/4,4'-oxydianiline, a polyimide of benzophenone tetracarboxylic dianhydride/4,4'-oxydianiline/phenylenediamine, and mixtures thereof.

For the generation of the polyimides selected for the fuser members illustrated herein, there can be utilized the disclosed polyamic acids of biphenyl tetracarboxylic dianhydride/phenylenediamine including U-VARNISH™ A, and S (about 20 weight in NMP), both available from UBE America Incorporated, New York, N.Y., PI-2610 (about 10.5 weight in NMP), and PI-2611 (about 13.5 weight in NMP), both available from HD MicroSystems, Parlin, N.J.

Commercially available examples of polyamic acids of pyromellitic dianhydride/4,4'-oxydianilines selected include PYRE-ML™ RC5019 (about 15 to 16 weight percent in N-methyl-2-pyrrolidone, known as NMP), RC5057 (about 14.5 to 15.5 weight percent in a NMP/aromatic hydrocarbon, 80/20), and RC5083 (about 18 to 19 weight percent in a NMP/DMAc, 15/85), all available from Industrial Summit Technology Corporation, Parlin, N.J.; and DURIMIDE® 100, commercially available from FUJIFILM Electronic Materials U.S.A., Incorporated.

Commercially available examples of polyamic acids of benzophenone tetracarboxylic dianhydride/4,4'-oxydianilines include RP46 and RP50 (about 18 weight percent in NMP), both available from Unitech Corp., Hampton, Va.; while commercially available examples of polyamic acids of benzophenone tetracarboxylic dianhydride/4,4'-oxydianiline/phenylenediamine include PI-2525 (about 25 weight percent in NMP), PI-2574 (about 25 weight percent in NMP), PI-2555 (about 19 weight percent in NMP/aromatic hydrocarbon, 80/20), and PI-2556 (about 15 weight percent in NMP/aromatic hydrocarbon/propylene glycol methyl ether, 70/15/15), all available from HD MicroSystems, Parlin, of N.J.

More specifically, polyamic acids or esters of polyamic acids examples that can be selected for the formation of a polyimide are prepared by the reaction of a dianhydride and a diamine. Suitable dianhydrides selected for the reaction include aromatic dianhydrides and aromatic tetracarboxylic acid dianhydrides such as, for example, 9,9-bis(trifluoromethyl)xanthene-2,3,6,7-tetracarboxylic acid dianhydride, 2,2-bis(3,4-dicarboxyphenyl)hexafluoropropane dianhydride, 2,2-bis((3,4-dicarboxyphenoxy)phenyl)hexafluoropropane dianhydride, 4,4'-bis(3,4-dicarboxy-2,5,6-trifluorophenoxy)octafluorobiphenyl dianhydride, 3,3',4,4'-tetracarboxybiphenyl dianhydride, 3,3',4,4'-tetracarboxybenzophenone dianhydride, di-(4-(3,4-dicarboxyphenoxy)phenyl)ether dianhydride, di-(4-(3,4-dicarboxyphenoxy)phenyl)sulfide dianhydride, di-(3,4-dicarboxyphenyl)methane dianhydride, di-(3,4-dicarboxyphenyl)ether dianhydride, 1,2,4,5-tetracarboxybenzene dianhydride, 1,2,4-tricarboxybenzene dianhydride, butanetetracarboxylic dianhydride, cyclopentanetetracarboxylic dianhydride, pyromellitic dianhydride, 1,2,3,4-benzenetetracarboxylic dianhydride, 2,3,6,7-naphthalenetetracarboxylic dianhydride, 1,4,5,8-naphthalenetetracarboxylic dianhydride, 1,2,5,6-naphthalenetetracarboxylic dianhydride, 3,4,9,10-perylenetetracarboxylic dianhydride, 2,3,6,7-anthracene tetracarboxylic dianhydride, 1,2,7,8-phenanthrenetetracarboxylic dianhydride, 3,3',4,4'-biphenyltetracarboxylic dianhydride, 2,2',3,3'-biphenyltetracarboxylic dianhydride, 3,3',4-4'-benzophenonetetracarboxylic dianhydride, 2,2',3,3'-benzophenonetetracarboxylic dianhydride, 2,2-bis(3,4-dicarboxyphenyl)propane dianhydride, 2,2-bis(2,3-dicarboxyphenyl)propane dianhydride, bis(3,4-dicarboxyphenyl)ether dianhydride, bis(2,3-dicarboxyphenyl)ether dianhydride, bis(3,4-dicarboxyphenyl)sulfone dianhydride, bis(2,3-dicarboxyphenyl)sulfone 2,2-bis(3,4-dicarboxyphenyl)-1,1,1,3,3,3-hexafluoropropane dianhydride, 2,2-bis(3,4-dicarboxyphenyl)-1,1,1,3,3,3-hexachloropropane dianhydride, 1,1-bis(2,3-dicarboxyphenyl)ethane dianhydride, 1,1-bis(3,4-dicarboxyphenyl)ethane dianhydride, bis(2,3-dicarboxyphenyl)methane dianhydride, bis(3,4-dicarboxyphenyl)methane dianhydride, 4,4'-(p-phenylenedioxy)diphthalic dianhydride, 4,4'-(m-phenylenedioxy)diphthalic dianhydride, 4,4'-diphenylsulfidedioxybis(4-phthalic acid)dianhydride, 4,4'-diphenylsulfonedioxybis(4-phthalic acid)dianhydride, methylenebis(4-phenyleneoxy-4-phthalic acid)dianhydride, ethylidenebis(4-phenyleneoxy-4-phthalic acid)dianhydride, isopropylidenebis(4-phenyleneoxy-4-phthalic acid)dianhydride, hexafluoroisopropylidenebis(4-phenyleneoxy-4-phthalic acid)dianhydride, mixtures thereof, and the like.

Exemplary diamines selected for the reaction with the illustrated herein dianhydrides, and suitable for use in the preparation of polyamic acids include 4,4'-bis-(m-aminophenoxy)-biphenyl, 4,4'-bis-(m-aminophenoxy)-diphenyl sulfide, 4,4'-bis-(m-aminophenoxy)-diphenyl sulfone, 4,4'-bis-(p-aminophenoxy)-benzophenone, 4,4'-bis-(p-aminophenoxy)-diphenyl sulfide, 4,4'-bis-(p-aminophenoxy)-diphenyl sulfone, 4,4'-diamino-azobenzene, 4,4'-diaminobiphenyl, 4,4'-diaminodiphenylsulfone, 4,4'-diamino-p-terphenyl, 1,3-bis-(gamma-aminopropyl)-tetramethyl-disiloxane, 1,6-diaminohexane, 4,4'-diaminodiphenylmethane, 3,3'-diaminodiphenylmethane, 1,3-diaminobenzene, 4,4'-diaminodiphenyl ether, 2,4'-diaminodiphenylether, 3,3'-diaminodiphenylether, 3,4'-diaminodiphenylether, 1,4-diaminobenzene, 4,4'-diamino-2,2',3,3',5,5',6,6'-octafluoro-biphenyl, 4,4'-diamino-2,2',3,3',5,5',6,6'-octafluorodiphenyl ether, bis[4-(3-aminophenoxy)-phenyl]sulfide, bis[4-(3-aminophenoxy)phenyl]sulfone, bis[4-(3-aminophenoxy)phenyl]ketone, 4,4'-bis(3-aminophenoxy)biphenyl, 2,2-bis[4-(3-aminophenoxy)phenyl]-propane, 2,2-bis[4-(3-aminophenoxy)phenyl]-1,1,1,3,3,3-hexafluoropropane, 4,4'-diaminodiphenyl sulfide, 4,4'-diaminodiphenyl ether, 4,4'-diaminodiphenyl sulfone, 4,4'-diaminodiphenylmethane, 1,1-di(p-aminophenyl)ethane, 2,2-di(p-aminophenyl)propane, 2,2-di(p-aminophenyl)-1,1,1,3,3,3-hexafluoropropane, and the like, and mixtures thereof.

The dianhydrides and diamines reactants are selected, for example, in a weight ratio of from about 20:80 to about 80:20, and more specifically, in an about 50:50 weight ratio.

Yet more specifically, examples of polyamic acids utilized in effective amounts, such as from about 90 to about 99.99 weight percent, from about 95 to about 99 weight percent, or from about 98 to about 99.95 weight percent of the solids, include a polyamic acid of pyromellitic dianhydride/4,4'-oxydianiline, commercially available from Industrial Summit technology Corp., Parlin, N.J. as Pyre-M.L.™ RC5019 or RC5083, and a polyamic acid of biphenyl tetracarboxylic dianhydride/phenylenediamine, commercially available as U-VARNISH™ A and S (about 20 weight in NMP), both available from UBE America Inc., New York, N.Y., or both available from Kaneka Corp., TX.

Polyimide examples selected for the disclosed fuser member compositions are, for example, represented by at least one of the following formulas/structures, and mixtures thereof

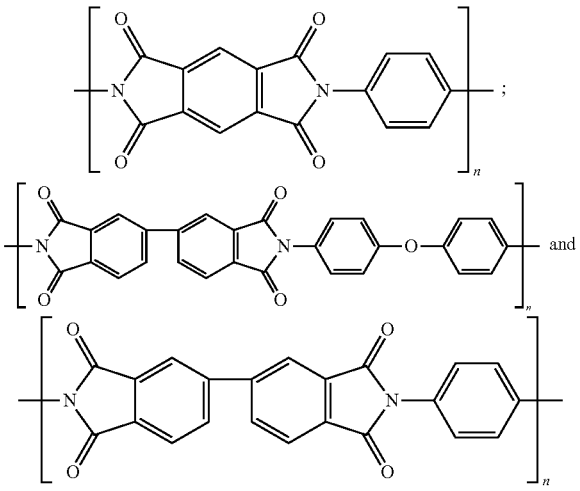

where n represents the number of repeating segments of, for example, from about 5 to about 3,000, from about 50 to about 2,000, from about 50 to about 1,500, from about 200 to about 1,200, from about 1,000 to about 2,000, from about 1,200 to about 1,800, or from about 20 to about 400.

Aramid Polymers

Aramid polymer examples that can be mixed with the polyimide containing mixture, or where the polyimide may be mixed with the aramid polymers, include poly-metaphenylene isophthalamides available as NOMEX®, TEIJIN-CONEX® or NEW STAR®; copolyamides available as TECHNORA®; poly-paraphenylene terephthalamides available as TWARON®, mixtures thereof, and the like.

Also, aramid polymer examples, especially inclusive of those in the configuration of fibers, are commercially available from E.I. DuPont as, for example, KEVLAR®, considered a poly-paraphenylene terephthalamide that is reported as having a number of long-chain polyamides, and that can be represented by the following formula/structure

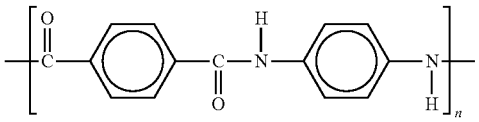

wherein n represents the number of repeating segments, and n is a number of, for example, from about 10 to about 1,000, from about 10 to about 900, from about 10 to about 750, from about 15 to about 975, from about 15 to about 500, from about 50 to about 700, from about 100 to about 700, from about 100 to about 550, from about 150 to about 400, from about 400 to about 1,000, from about 200 to about 700, from about 200 to about 500, from about 200 to about 300, from about 175 to about 400, from about 20 to about 500, and the like.

The aramid polymers in the configuration of fibers are of various lengths and diameters, such as for example, a length of from about 0.1 to about 10 millimeters, from about 0.3 to about 8 millimeters, or from about 0.5 to about 5 millimeters, and a diameter of, for example, from about 1 to about 1,000 microns, from about 5 to about 800 microns, or from about 10 to about 500 microns.

The amount of aramid polymers, such as fibers, present in the disclosed mixture is, for example, from about 0.1 to about 40 weight percent, from about 0.1 to about 30 weight percent, from about 0.5 to about 35 weight percent, from about 1 to about 30 weight percent, from about 1 to about 25 weight percent, from about 1 to about 20 weight percent, from about 1 to about 17 weight percent, or from about 2 to about 15 weight percent based on the solids present. In embodiments, the fuser member composition of the polyimide polymer and the aramid fibers are present, for example, in a weight ratio of from about 99.9/0.1 to about 60/40, and more specifically, in a weight ratio of about 95/5.

Additionally, the resulting mixtures of polyimides and aramid polymers, such as those in the configuration of fibers, after final curing self-releases from a metal coating substrate like stainless steel, and a thick smooth polyimide and aramid composition fuser member can be obtained.

One specific disclosed fuser member comprises a mixture of a polyimide of biphenyl tetracarboxylic dianhydride/phenylenediamine, and the disclosed aramid polymers, prepared in a suitable solvent in, for example, from about 16 to about 20 percent by weight of solids, and where the disclosed polyimide aramid polymer weight ratio is, for example, 95/5.

Functional Intermediate Layers

Examples of materials selected for the functional intermediate layers, or layer, also referred to as a cushioning layer or an intermediate layer, situated in contact with a polyimide and aramid polymer mixture layer, and that can provide elasticity to the fuser member and the materials in the layer or layers, and which materials can be optionally mixed with inorganic particles, such as for example, SiC or $Al_2O_3$, include fluorosilicones, silicones, silicone rubbers, such as room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC® 735 black RTV and SILASTIC® 732 RTV, both obtainable from Dow Corning; 106 RTV Silicone Rubber and 90 RTV Silicone Rubber, both obtainable from General Electric; JCR6115CLEAR HTV and SE4705U HTV silicone rubbers obtainable from Dow Corning; Toray Silicones; commercially available LSR rubbers obtainable from Dow Corning as Q3-6395, Q3-6396; SILASTIC® 590 LSR, SILASTIC® 591 LSR, SILASTIC® 595 LSR, SILASTIC® 596 LSR, and SILASTIC® 598 LSR; and siloxanes, such as polydimethylsiloxanes; Silicone Rubber 552, available from Sampson Coatings, Richmond, Va.; and liquid silicone rubbers such as vinyl crosslinked heat curable rubbers or silanol room temperature crosslinked materials.

Further materials suitable for use in the functional intermediate layer or layers also include fluoroelastomers. Fluoroelastomers are considered as being from the class of 1. copolymers of two of vinylidenefluoride, hexafluoropropylene, and tetrafluoroethylene; 2. terpolymers of vinylidenefluoride, hexafluoropropylene, and tetrafluoroethylene; and 3. tetrapolymers of vinylidenefluoride, hexafluoropropylene, tetrafluoroethylene, and a cure site monomer. These fluoroelastomers are commercially available under various designations such as VITON A®, VITON B®, VITON E®, VITON E 60C®, VITON E430®, VITON 910®, VITON GH®; VITON GF®; and VITON ETP®. The VITON® designation is a trademark of E.I. DuPont de Nemours, Incorporated. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or other suitable known cure site monomers, such as those commercially available from DuPont.

Commercially available fluoropolymers that can be selected for the intermediate layer or intermediate layers include FLUOREL 2170®, FLUOREL 2174®, FLUOREL 2176®, FLUOREL 2177® and FLUOREL LVS 76®, FLUOREL® being a registered trademark of 3M Company. Additional commercially available selected fluoroelastomers materials include AFLAS™, a poly(propylene-tetrafluoroethylene), and FLUOREL II® (LII900), a poly(propylene-tetrafluoroethylenevinylidenefluoride), both available from 3M Company, as well as the Tecnoflons identified as FOR-60KIR®, FOR-LHF®, NM® FOR-THF®, FOR-TFS®, TH®, NH®, P757®, TNS®, T439®, PL958®, BR9151® and TN505®, available from Ausimont Incorporated.

The fluoroelastomers VITON GH® and VITON GF® have relatively low amounts of vinylidenefluoride. For example, the VITON GF® and VITON GH® have about 35 weight percent of vinylidenefluoride, about 34 weight percent of hexafluoropropylene, and about 29 weight percent of tetrafluoroethylene, with about 2 weight percent cure site monomer.

The thickness of a functional intermediate layer is, for example, from about 30 to about 1,000 microns, from about 100 to about 800 microns, or from about 150 to about 500 microns.

Optional Polymers

The disclosed polyimide/aramid polymer fuser member composition can optionally contain a polysiloxane polymer to enhance or smooth the composition when it is applied as a coating. The concentration of the polysiloxane copolymer is equal to or less than about 1 weight percent or equal to or less than about 0.2 weight percent, and more specifically, from about 0.1 to about 1 weight percent. The optional polysiloxane polymers include, for example, a polyester modified polydimethylsiloxane, commercially available from BYK Chemical, with the trade name of BYK® 310 (about 25 weight percent in xylene) and BYK® 370 (about 25 weight percent in xylene/alkylbenzenes/cyclohexanone/monophenylglycol=75/11/7/7); a polyether modified polydimethylsiloxane, commercially available from BYK Chemical, with the trade name of BYK® 330 (about 51 weight percent in methoxypropylacetate) and BYK® 344 (about 52.3 weight percent in xylene/isobutanol, 80/20), BYK®-SILCLEAN 3710 and 3720 (about 25 weight percent in methoxypropanol); a polyacrylate modified polydimethylsiloxane, commercially available from BYK Chemical, with the trade name of BYK®-SILCLEAN 3700 (about 25 weight percent in methoxypropylacetate); or a polyester polyether modified polydimethylsiloxane, commercially available from BYK Chemical, with the trade name of BYK® 375 (about 25 weight percent in di-propylene glycol monomethyl ether). The polyimide/aramid polymers/polysiloxane polymer is present in, for example, a weight ratio of about 99.89/0.1/0.01 to about 59/40/1.

Optional Overcoating

Examples of the selected fuser member optional overcoating layer in contact with the disclosed intermediate layer, and which overcoating can function as a release layer and a protective layer, includes fluoropolymers, such as fluorine-containing polymers, comprising a monomeric repeat unit that is selected from the group consisting of vinylidene fluoride, hexafluoropropylene, tetrafluoroethylene, perfluoroalkylvinylether, and mixtures thereof. The fluoropolymers may include linear or branched polymers, and crosslinked fluoroelastomers. Examples of fluoropolymers include polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF) and hexafluoropropylene (HFP); tetrapolymers of tetrafluoroethylene (TFE), vinylidene fluoride (VF2), and hexafluoropropylene (HFP), and mixtures thereof. The fluoropolymers, which can have a low surface energy, when present, can provide enhanced chemical and thermal stability to the disclosed fuser members and in the form of particles have a melting temperature of, for example, from about 255° C. to about 360° C. or from about 280° C. to about 330° C.

The thickness of the outer surface overcoating layer can be, for example, from about 10 to about 100 microns, from about 20 to about 80 microns, or from about 40 to about 60 microns.

Optional Adhesive Layers

Optionally, any known and available suitable adhesive layers, also referred to as primer layers, (not shown in the Figures) may be positioned between the overcoating layer, the functional intermediate layer and the substrate layer mixture of the polyimide and the aramid polymers. Examples of suitable adhesives include silanes such as amino silanes, such as, for example, HV Primer 10 available from Dow Corning, titanates, zirconates, aluminates, and the like, and mixtures thereof. In an embodiment, an adhesive layer in from about 0.001 to about 10 percent solution can be wiped on the substrate. The adhesive layer or layers can be applied by any suitable known technique, including spray coating or wiping, and can be coated to a thickness of, for example, from about 2 to about 2,000 nanometers, from about 2 to about 500 nanometers, from about 10 to about 400 nanometers, from about 100 nanometers to about 375 nanometers, and other suitable thicknesses.

Fuser Member Preparation

The disclosed fuser member can be prepared as illustrated herein, such as by simply mixing the polyimides and the aramid polymers, and also by optionally flow coating of the polyimides and aramid polymers mixture on a supporting substrate. Thus, the polyimide/aramid mixture and optional components or layers that may be present can be flow coated on a seamless or welded stainless steel cylinder, a glass cylinder or an electroformed seamless nickel cylinder at the desired product circumference. Subsequently, the polyimide precursor and aramid polymer containing mixture can be partially cured, or pre-cured and then fully cured as illustrated herein resulting in the polyimide and aramid polymer mixture.

The disclosed fuser member composition mixture can also be coated on a substrate by liquid spray coating, dip coating, wire wound rod coating, fluidized bed coating, powder coating, electrostatic spraying, sonic spraying, blade coating, molding, laminating, and the like.

The polyimide and aramid polymer, such as those polymers in the configuration of fibers coating composition mixture, can include a solvent, primarily for the formation of the dispersion to be coated. Examples of the solvent selected to form and apply the coating composition mixture and other layers illustrated herein, include toluene, hexane, cyclohexane, heptane, tetrahydrofuran, methyl ethyl ketone, methyl isobutyl ketone, N,N'-dimethylformamide, N,N'-dimethylacetamide, N-methyl pyrrolidone (NMP), methylene chloride, dimethylacetates (DMAc) and mixtures thereof, and the like, where the solvent is selected, for example, in an amount of from about 70 to about 95 weight percent, and from 80 to about 90 weight percent based on the amounts of component in the coating mixture.

Additives and conductive or non-conductive fillers in various amounts, such as for example, from about 1 to about 40 weight percent, from 2 to about 25 weight percent, or from 3 to about 15 weight percent of the solids, may be present in the mixture of the polyimide and the aramid polymer of the disclosed fuser member coating composition including, for example, inorganic particles. Examples of selected fillers are aluminum nitride, boron nitride, aluminum oxide, graphite, graphene, copper flake, nano diamond, carbon black, carbon nanotube, metal oxides, doped metal oxide, metal flakes, and mixtures thereof.

Self-release characteristics without the assistance of any external sources, such as prying devices, permits the efficient, economical formation, and full separation, from about 90 to about 100 percent, or from about 95 to about 99 percent of the disclosed fuser member mixture of the polyimides and the aramid polymers compositions from metal substrates, and where release materials and separate release layers can be avoided. The time period to obtain the self-release characteristics of the disclosed fuser member mixture of the polyimides and the aramid polymers varies depending, for example, on the components present, and the amounts thereof selected. Generally, however, the release time period is from about 1 to about 65 seconds, from about 1 to about 50 seconds, from about 1 to about 35 seconds, from about 1 to about 20 seconds, or from about 1 to about 5 seconds, and in some instances less than 1 second.

Specific embodiments will now be described in detail. These examples are intended to be illustrative, and not limited to the materials, conditions, or process parameters set forth in these embodiments. All parts are percentages by solid weight unless otherwise indicated.

EXAMPLE I

Experimentally, a polyamic acid of biphenyl tetracarboxylic dianhydride/p-benzenedianiline (BPDA resin available from Kaneka, about 16 weight percent in NMP) was mixed with KEVLAR® aramid pulp fibers where the KEVLAR® is represented by the following formula/structure, with a high shear mixer at the weight ratio of the polyamic acid to KEVLAR® of 95/5. After coating and subsequent curing at 170° C. for 30 minutes and then 320° C. for 120 minutes, the polyamic acid of biphenyl tetracarboxylic dianhydride/phenylenediamine was converted to a polyimide of biphenyl tetracarboxylic dianhydride/phenylenediamine, followed by cooling to room temperature, about 23° C., resulting in a polyimide/aramid fibers composite fuser belt

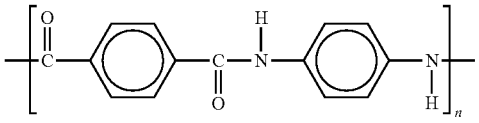

wherein n represents the number of repeating segments, and is a number of about 200.

The above resulting polyimide/aramid fuser belt mixture and the Comparative Example 1 fuser belt were tested for thermal diffusivity, which is determined by the thermal conductivity divided by the density and by the specific heat capacity at constant pressure, and refers to the ability of a material to conduct thermal energy relative to its ability to store thermal energy, or refers to the rate at which heat flows through a material, typically measured in $mm^2/s$ or $inches^2/hour$, and for thermal conductivity, which is the property of a material to conduct heat. Heat transfer occurs at a higher rate across materials of high thermal conductivity than across materials of low thermal conductivity.

An ALFA 447 Nanoflash instrument was used to measure both the thermal diffusivities and the thermal conductivities. The results are provided in FIGS. 5 to 8.

COMPARATIVE EXAMPLE 1

A fuser belt was prepared by repeating the process of Example I with the exception that no aramid fibers were included in the fuser belt mixture.

Figure 5:
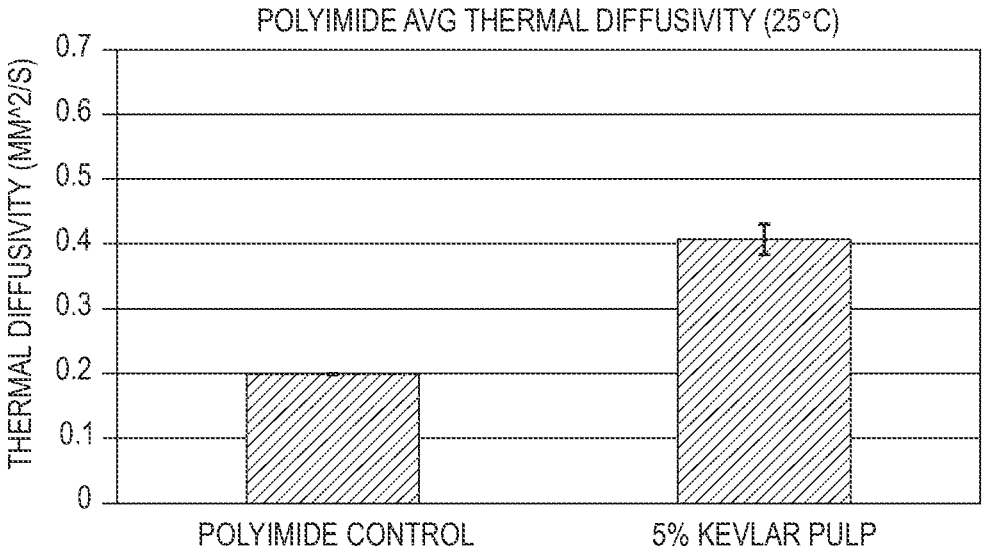
FIG. 5 illustrates the disclosed average (Avg) thermal diffusivity of the disclosed fuser member versus a polyimide fuser member at 25° C.
Figure 6:
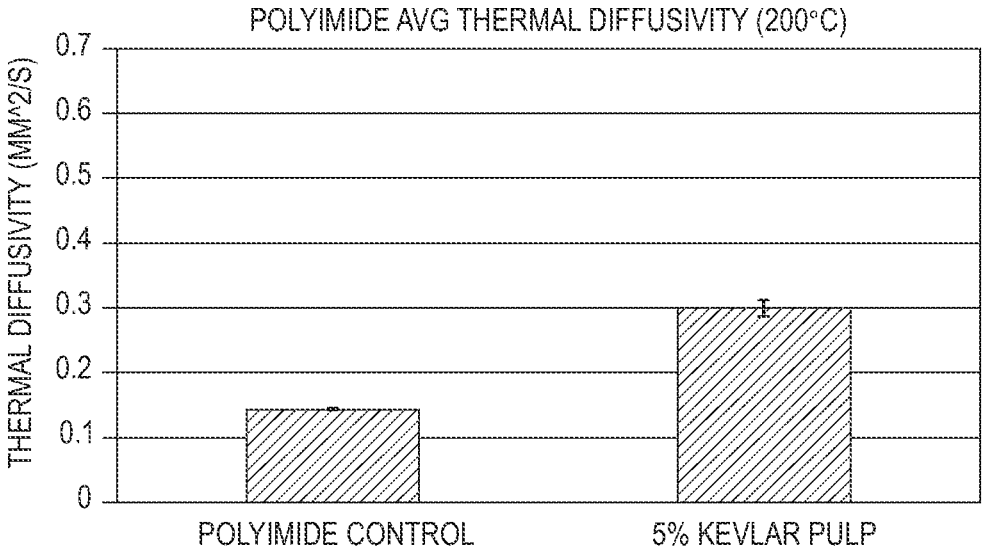
FIG. 6 illustrates the average thermal diffusivity of the disclosed fuser member versus a polyimide fuser member at 200° C.

FIGS. 5 and 6 shows that the fuser member thermal diffusivity at 25° C. and 200° C. (approximate toner fusing temperature) were increased by about 105 percent and about 105 percent, respectively, when aramid fibers (KEVLAR® pulp) were mixed with, or incorporated into the polyimide versus the Comparative Example 1 polyimide fuser member.

Figure 7:
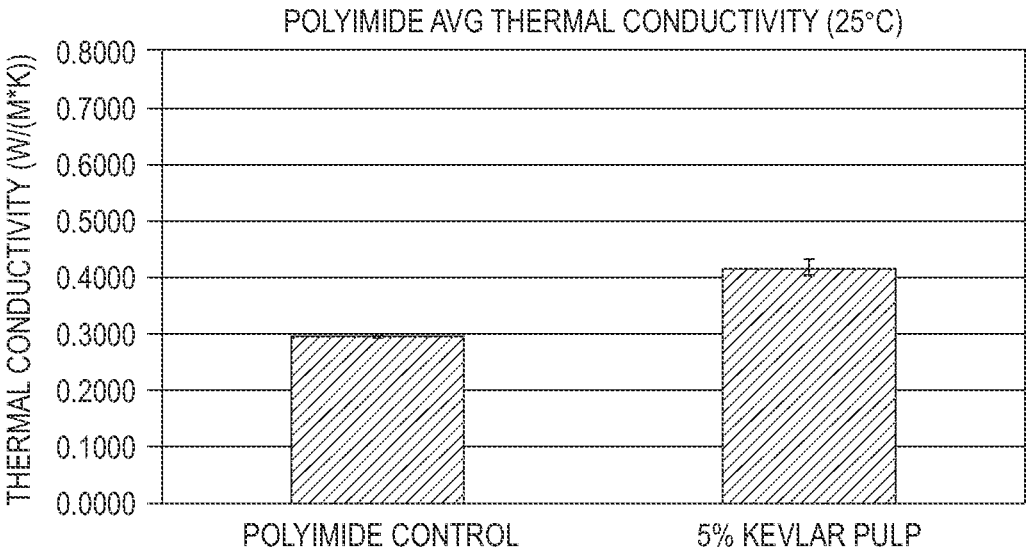
FIG. 7 illustrates the average thermal conductivity of the disclosed fuser member versus a polyimide fuser member at 25° C.
Figure 8:
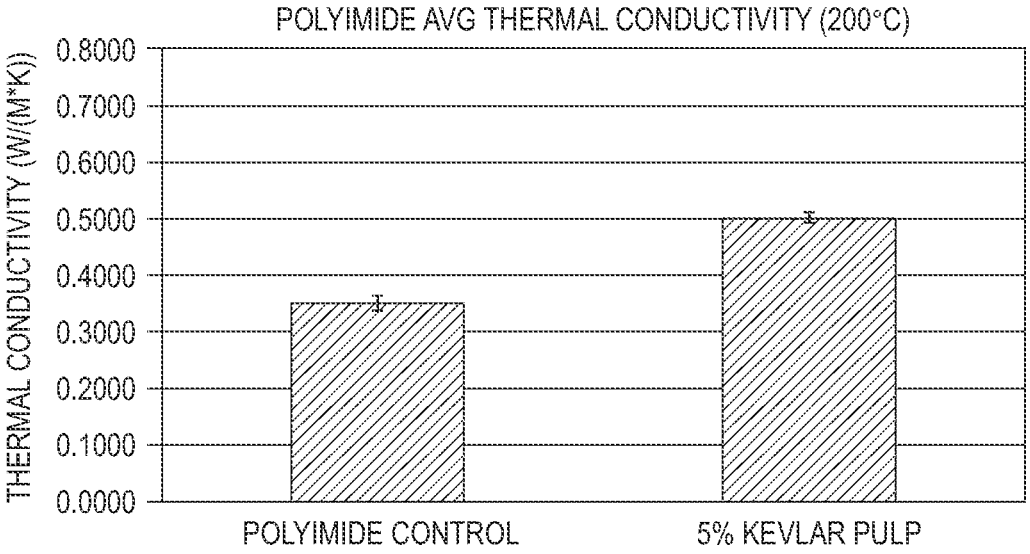
FIG. 8 illustrates the average thermal conductivity of the disclosed fuser member versus a fuser member of a polyimide at 200° C.

FIGS. 7 and 8 show that the fuser member thermal conductivities at 25° C. and 200° C., approximate toner fusing temperature, were increased by about 41 percent and about 43 percent, respectively, when aramid fibers were mixed with, or incorporated into the polyimide versus the Comparative Example 1 polyimide fuser member.

The increase in both thermal diffusivity and conductivity means, for example, that an energy saving fuser member is achieved with the mixture of the polyimide and the aramid fibers versus the Comparative Example 1 polyimide fuser member.

In addition, the Young's modulus of the above prepared polyimide and aramid fiber mixture fuser belt was significantly increased when compared with the polyimide control belt of Comparative Example 1, as shown in the following Table which means. for example, that a mechanically stronger fuser member is achieved with the aramid fibers containing polyimide mixture versus the Comparative Example 1 polyimide fuser member.

| Example Number | Young's Modulus (MPa) |
|---|---|
| Example I | 7,600 |
| Comparative Example 1 | 5,800 |

The Young's Modulus was measured by following the known ASTM D882-97 test method or procedure. A sample (0.5 inch×12 inch) of the fuser members or belts prepared above were placed in an Instron Tensile Tester measurement apparatus, and then the samples were elongated at a constant pull rate until breaking. During this time, there was recorded the resulting load versus the sample elongation. The Young's Modulus was calculated by taking any point tangential to the initial linear portion of the recorded curve results and dividing the tensile stress by the corresponding strain. The tensile stress was calculated by the load divided by the average cross-sectional area of each of the tests.

The disclosed aramid fibers containing fuser member mixtures can be selected as a fuser device or a fuser belt in a xerographic imaging process, or the polyimide/aramid fibers mixture can be coated on a supporting substrate such as a polymer or other suitable known substrates.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A fuser member consisting of a mixture of a polyimide and an aramid polymer wherein said aramid polymer is in the configuration of fibers, and wherein said aramid fibers are represented by the following formula/structure

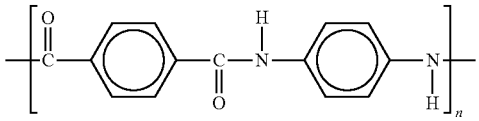

wherein n represents the number of repeating segments and wherein said fibers have a diameter of from about 1 to about 1,000 microns; wherein said mixture optionally contains a polysiloxane polymer selected from the group consisting of a polyester modified polydimethylsiloxane, a polyether modified polydimethylsiloxane, a polyacrylate modified polydimethylsiloxane, and a polyester polyether modified polydimethylsiloxane; wherein said mixture optionally contains components selected from the group consisting of aluminum nitride, boron nitride, aluminum oxide, graphite, graphene, copper flake, nano diamond, carbon black, carbon nanotube, metal oxides, doped metal oxide, metal flake, conducting polymers, and mixtures thereof, and a polysiloxane; wherein said fuser member optionally includes at least one functional intermediate layer disposed on the polyimide and aramid polymer mixture in the form of a substrate layer and an overcoating layer in contact with the at least one functional layer; wherein said intermediate layer comprises a silicone, a fluoroelastomer or mixtures thereof, and the overcoating layer comprises a fluoropolymer.

2. A fuser member in accordance with claim 1 that has a thermal diffusivity of from about 0.2 to about 0.4 square millimeter per second at about 25° C., and a thermal conductivity of from about 0.4 to about 0.6 watt per meter per Kelvin at about 25° C.

3. A fuser member in accordance with claim 1 that has a thermal diffusivity of from about 0.25 to about 0.35 square millimeters per second at about 200° C., and a thermal conductivity of from about 0.45 to about 0.55 watt per meter per Kelvin at about 200° C.

4. A fuser member in accordance with claim 1 wherein n is a number of from about 10 to about 1,000.

5. A fuser member in accordance with claim 1 wherein n is a number of from about 200 to about 500.

6. A fuser member in accordance with claim 1 wherein said aramid fibers are dispersed in said polyimide.

7. A fuser member in accordance with claim 1 wherein said aramid fibers are comprised of a plurality of fibers dispersed in said polyimide.

8. A fuser member in accordance with claim 1 wherein said fibers are of a length of from about 0.1 millimeter to about 10 millimeters.

9. A fuser member in accordance with claim 1 wherein said fibers are present in an amount of from about 0.1 weight percent to about 40 weight percent based on the solids.

10. A fuser member in accordance with claim 1 wherein said polyimide is represented by at least one of the following formulas/structures

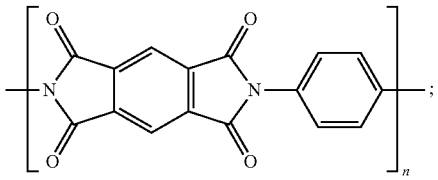

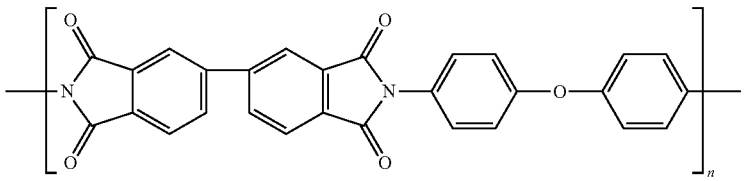

and

-continued

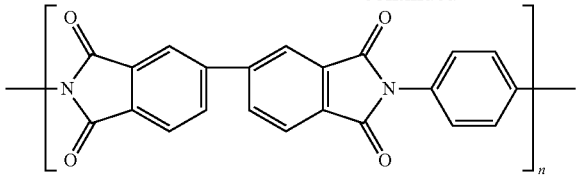

wherein n represents the number of repeating groups.

11. A fuser member in accordance with claim 10 wherein said polyimide is represented by the following formula/structure

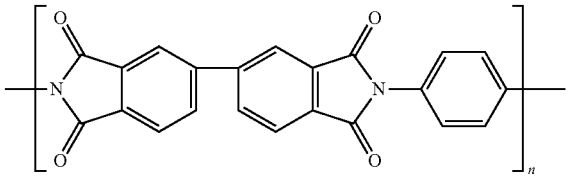

wherein n represents the number of segments and is a number of from about 20 to about 400.

12. A fuser member in accordance with claim 1 wherein said polyimide and said aramid polymer are present in a weight ratio of about 99.9/0.1 to about 60/40.

13. A xerographic fuser member comprising a mixture of a polyimide and aramid fibers as represented by the following formula/structure

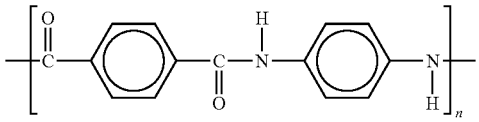

where n represents the number of repeating segments, and wherein said member has a thermal diffusivity of from about 0.2 to about 0.4 square millimeter per second at about 25° C., and a thermal conductivity of from about 0.4 to about 0.6 watt per meter per Kelvin at about 25° C. and wherein said fibers have a diameter of from about 1 to about 1,000 microns.

14. A xerographic fuser member in accordance with claim 13 wherein said polyimide is represented by at least one of the following formulas/structures

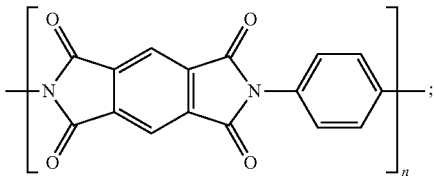

;

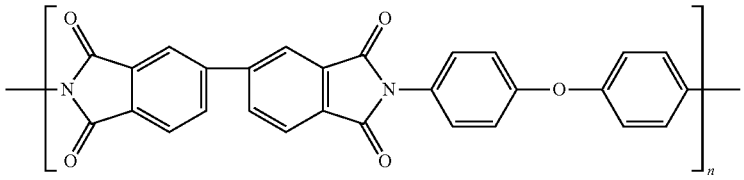

and

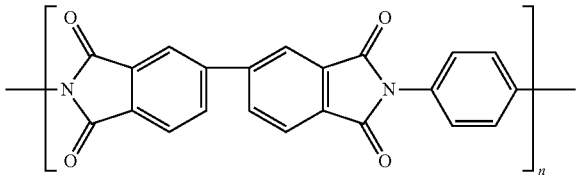

wherein n represents the number of repeating groups of from about 50 to about 2,000.

15. A xerographic fuser belt in accordance with claim 14 wherein said aramid fibers are present in an amount of from about 0.1 to about 30 weight percent of the solids.

16. A fuser belt comprised in sequence of a substrate comprised of a mixture of polyimides and aramid fibers, an intermediate layer comprising a silicone, a fluoroelastomer, or mixtures thereof, and a fluoropolymer overcoat layer present on the intermediate layer.

17. A fuser belt in accordance with claim 16 wherein said mixture has a thermal diffusivity of from about 0.25 to about 0.35 square millimeter per second at about 200° C., and a thermal conductivity of from about 0.45 to about 0.55 watt per meter per Kelvin at about 200° C.

18. A fuser member in accordance with claim 1 prepared by the flow coating of said mixture wherein said polyimide is generated from a polyimide precursor, and a solvent onto a supporting metal substrate, and pre-curing the coating composition at a temperature of from about 125° C. to about 250° C., followed by a final curing at a temperature of from about 250° C. to about 370° C., and wherein for said aramid fibers n is a number of from about 20 to about 500, which fuser member has a temperature dependent thermal diffusivity of from about 0.2 to about 0.4 square millimeter per second, and a temperature dependent thermal conductivity of from about 0.4 to about 0.6 watt per meter per Kelvin.

19. A fuser member in accordance with claim 18 wherein the solvent is selected from the group consisting of tetrahydrofuran, methyl ethyl ketone, methyl isobutyl ketone, N,N'-dimethylformamide, N,N'-dimethylacetamide, N-methylpyrrolidone, and methylene chloride.

* * * * *